US006774344B1

(12) United States Patent
Trowbridge et al.

(10) Patent No.: US 6,774,344 B1
(45) Date of Patent: Aug. 10, 2004

(54) PROCESS FOR ADHERING ROOFING MATERIAL TO A ROOF DECK AND ASSEMBLY THEREFOR

(75) Inventors: Geoff Trowbridge, Dunellen, NJ (US); Tommy Rodrigues, Union, NJ (US); Dave Mastropasqua, Norwood, NJ (US)

(73) Assignee: Building Materials Investment Corporation, Wilmington, DE (US)

( * ) Notice: Subject to any disclaimer, the term of this patent is extended or adjusted under 35 U.S.C. 154(b) by 42 days.

(21) Appl. No.: 10/355,303

(22) Filed: Jan. 30, 2003

(51) Int. Cl.[7] ..... E05B 5/00

(52) U.S. Cl. ..... 219/411; 52/745.11; 52/745.21; 52/543; 219/213; 219/538

(58) Field of Search ..... 52/518, 52, 522, 52/527, 543, 748.1, 746.11, 745.21, 741.4; 219/408, 411, 213, 538; 392/303, 355, 643, 435, 438; 156/273.9, 274.2

(56) References Cited

U.S. PATENT DOCUMENTS

| | | | | | |
|---|---|---|---|---|---|
| 2,546,743 | A | * | 3/1951 | Harrison | 219/547 |
| 3,129,316 | A | * | 4/1964 | Glass et al. | 219/213 |
| 3,214,565 | A | * | 10/1965 | Hager, Jr. | 392/435 |
| 3,431,972 | A | * | 3/1969 | Bernardi | 165/47 |
| 3,445,628 | A | * | 5/1969 | Bateman | 392/436 |
| 3,691,343 | A | * | 9/1972 | Norman | 219/213 |
| 3,806,702 | A | * | 4/1974 | Spencer | 219/528 |
| 4,040,867 | A | * | 8/1977 | Forestieri et al. | 136/244 |
| 5,813,184 | A | * | 9/1998 | McKenna | 52/518 |
| 6,166,352 | A | * | 12/2000 | Turton | 219/213 |
| 6,632,309 | B1 | * | 10/2003 | Hendrix et al. | 156/148 |

* cited by examiner

*Primary Examiner*—Carl D. Friedman
*Assistant Examiner*—Nahid Amiri
(74) *Attorney, Agent, or Firm*—William J. Davis; Marilyn J. Maue

(57) ABSTRACT

The process of adhering asphaltic roofing tiles to a roof deck by covering the tiles on the deck with a heat blanket capable of generating a temperature of at least the cure temperature of the tiles thereby sealing the tiles to the deck.

10 Claims, 1 Drawing Sheet

PROCESS FOR ADHERING ROOFING MATERIAL TO A ROOF DECK AND ASSEMBLY THEREFOR

BACKGROUND OF THE INVENTION

Figure 1:
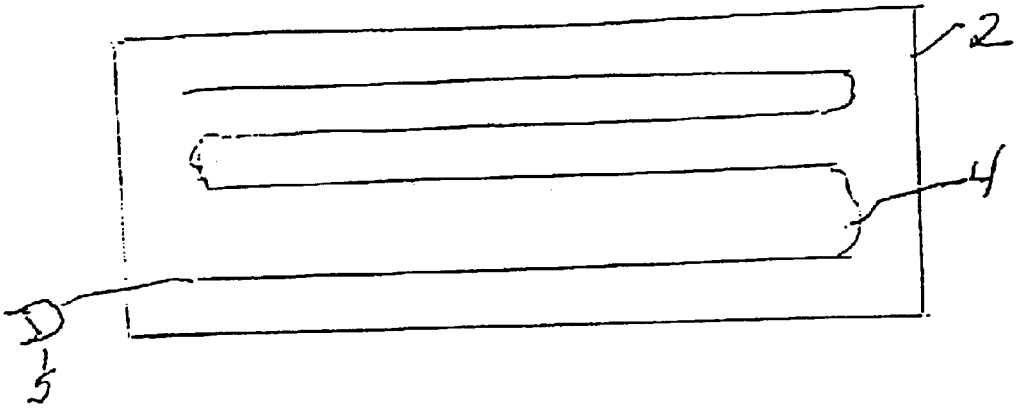

Prefabricated homes and commercial structures employ roofing units comprising asphaltic courses or shingles securely sealed on a roof deck for subsequent assembly and installation. Many of the processes heretofore employed for affixing asphaltic materials to a roof deck pose several problems involving cost and/or time consuming adherence. For example, certain processes require several days to cure and seal the asphaltic overlay to the deck structure. To overcome this drawback, costly radiant heating has been used to shorten the cure time; however, this solution, because of indirect heating sites, fails to provide uniform sealing results. As a consequence, a roof unit so treated is subject to sections of shingle or strip "blow off". Accordingly, it is an object of this invention to provide a process to overcome the above problems in an economical and commercially feasible manner. More specifically, it is an object of this invention to provide a process which reduces the asphalt adhesion time to not more than a few hours while simultaneously providing a seal which is uniformly secure over the entire deck surface of a prefabricated roof unit.

SUMMARY OF THE INVENTION

In accordance with this invention, an unattached asphaltic surface covering on a roof deck is contacted with a covering matrix containing a heating element at a temperature sufficient to cure the asphaltic material and seal it to the deck. The present roofing assembly comprises a wood, metal or concrete roof deck overlaid with asphaltic shingles or courses of asphaltic roofing material and a heatable matrix covering the asphaltic material and having a size and shape adapted to blanket at least a portion thereof, said matrix containing a heating element capable of distributing heat at a temperature sufficient to seal the asphaltic material to the deck.

DETAILED DESCRIPTION OF THE INVENTION

The heat generating matrix can be a single blanket covering the entire surface of the asphaltic covered roof or it can comprise several individual coverings adapted to cover sections thereof. Depending upon the pliability of the matrix, a single heating blanket, consistent with the roof dimensions, including valleys and ridges, is most preferred. However, in certain cases where the roof includes dormers or many uneven sections, it may be desirable to employ separate heating blankets over individual sections. The heating element embedded in the matrix is capable of generating a temperature of up to about 200° F., preferably between about 115° and about 185° F.

The blanket, comprising the matrix and the heating element, can be of a thickness of between about $\frac{1}{8}^{th}$ and about 2.5 inches, having a weight sufficient to provide intimate contact between the blanket and the asphaltic roofing material; broadly a weight of from about 0.1 to about 2 psi may be employed. However, a thickness of between about $\frac{1}{5}^{th}$ to about 1.5 inches is generally preferred. It is found that the weight of the blanket over the asphaltic material also assists in sealing it to the deck and the direct application of confined heat provides uniform attachment of the asphalt to the deck in the area of intended treatment.

The matrix of the invention is composed of natural or synthetic rubber or other inert material, modified when needed for flexibility, so as to conform with the roof surface. More specifically, the matrix can be composed of woven or non-woven material which can withstand the temperature of asphalt sealing without loss of size or shape integrity. Such matrices include a ceramic wool mat, a glass mat, a mat of silicon rubber and other similar products.

Although the preferred heating element in the matrix is an electrical metal coil or wire, other heat transmitting means are contemplated within the scope of this invention. For example, a hollow tube or plurality of tubes transporting air, water or oil can be incorporated in the matrix. Solar power can also supply the heat needed in a matrix having one or more reflective surfaces. The heating element can be localized over the area where sealing is needed or it can be distributed throughout or in larger portions of the matrix to heat and seal larger areas of the asphaltic material. Exceptionally good heat distribution is achieved when larger sections of the asphalt is covered with the heat blanket containing spaced heating elements since a uniform heat by convection is achieved in the pockets between the spaces.

The asphalt roof covering is any of the conventional types which have a curing temperature of between about 100° and about 185° F. The sealing process is cost effective and simply involves placing the above described heating blanket in contact with the asphaltic covered roof deck and heating the blanket to at least the curing temperature of the asphalt for a period sufficient to achieve strong and uniform bonding between the deck and asphalt material which is usually a period of from about 0.25 to about 3 hours; although generally a heating time of not more than 1.5 hours is sufficient. After attachment is complete, the blanket is removed and a wind lift resistant product is obtained. This process is particularly useful for prefabricated roofing where subsequent building assembly is required.

Figure 2:
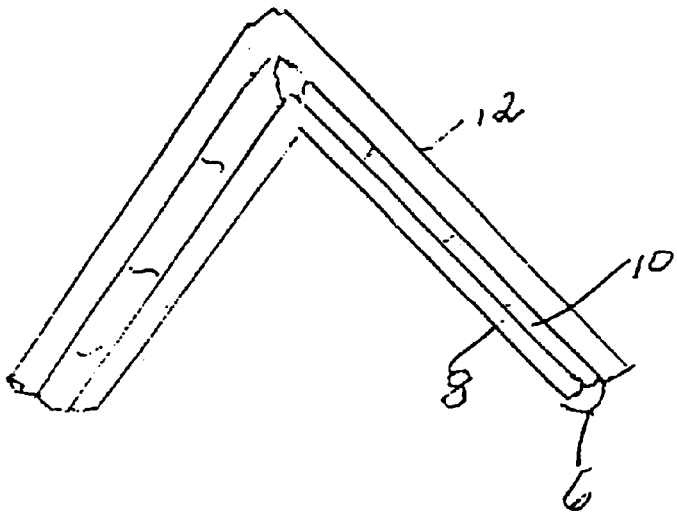

Reference is now had to FIG. 1 of the drawings which illustrates flexible matrix 2 containing a preferred embodiment of heating element, i.e. serpentine copper alloy wire 4 having connection plug 5. FIG. 2 is a front view illustrating roofing assembly 6 comprising deck 8 and courses of asphalt covering 10 in contact with heating blanket 12.

What is claimed is:

1. A roofing assembly comprising a roof deck, overlaid with a conventional asphaltic material sealable to the deck at a temperature of between about 110° and about 180° C. and an integral matrix covering the asphaltic material, which matrix contains a heating element capable of generating a temperature of at least the sealing temperature of the asphaltic material.

2. The roofing assembly of claim 1 wherein said matrix has a thickness of between about $\frac{1}{8}^{th}$ and 2.5 inches.

3. The roofing assembly of claim 2 wherein said matrix has a thickness of between about $\frac{1}{5}^{th}$ and about 1.5 inches.

4. The roofing assembly of claim 1 wherein the weight of the matrix over the asphaltic material promotes Intimate contact between the asphaltic material and the roof deck.

5. The roofing assembly of claim 1 wherein said heating element is a metal coil or wire.

6. The roofing assembly of claim 1 wherein said assembly is a prefabricated roof.

7. The assembly of claim 1 wherein the matrix is a woven or non-woven mat composed of natural or synthetic rubber, ceramic wool, glass or other synthetic fibers capable of maintaining integrity at the sealing temperature.

8. The assembly of claim 1 wherein the heating element generates a temperature of between about 110° and about 200° F.

9. The assembly of claim 1 wherein said asphaltic material is a plurality of roofing courses.

10. The assembly of claim 1 wherein said asphaltic material is a plurality of roofing shingles.

* * * * *